United States Patent [19]

Palz et al.

[11] 4,005,982

[45] Feb. 1, 1977

[54] HOT-BLAST STOVE FOR A BLAST FURNACE

[75] Inventors: Helmut Palz, Wiesbaden; Rudolf Hebel, Ginsheim; Otto Bauersachs, Saarbrucken, all of Germany

[73] Assignee: Didier-Werke AG, Wiesbaden, Germany

[22] Filed: Sept. 25, 1975

[21] Appl. No.: 616,897

[30] Foreign Application Priority Data

Sept. 28, 1974 Germany ..... 2446407

[52] U.S. Cl. ..... 432/248; 432/217; 110/99 R

[51] Int. Cl.[2] ..... F27B 14/08

[58] Field of Search ..... 432/30, 40, 54, 214, 432/216, 217, 247, 248, 251, 252; 110/1 A, 1 R, 1 L, 99 R

[56] References Cited

UNITED STATES PATENTS

| | | | |
|---|---|---|---|
| 2,376,099 | 5/1945 | Swartz | 432/217 |
| 2,989,296 | 6/1961 | Corriston | 110/99 R |
| 3,241,823 | 3/1966 | Pentek | 432/216 |
| 3,334,880 | 8/1967 | Nishida et al. | 432/214 |
| 3,416,780 | 12/1968 | Hanna | 432/248 |
| 3,690,627 | 9/1972 | Van Herk et al. | 432/40 |

*Primary Examiner*—John J. Camby
*Assistant Examiner*—Henry C. Yuen
*Attorney, Agent, or Firm*—Wenderoth, Lind & Ponack

[57] ABSTRACT

A shaft casing has a funnel-shaped widened upper portion connected to a cupola casing. Between the widened portion and a refractory shaft lining is a supporting frame having a platform on which a cupola lining rests. The frame is connected to the lower end of the widened portion.

12 Claims, 5 Drawing Figures

HOT-BLAST STOVE FOR A BLAST FURNACE

BACKGROUND OF THE INVENTION

The present invention relates to a hot-blast stove for use in blast furnaces and of the type including a cylindrical metallic shaft casing which has a funnel-shaped widened portion joined to a metallic cupola of a larger diameter than the cylindrical casing, the refractory lining of the cupola being arranged independently of the refractory lining of the cylindrical shaft, which cylindrical shaft lining surrounds a combustion chamber and a grating chamber within the cylindrical shaft.

Hot-blast stoves of the above-mentioned type, i.e. so-called inner-shaft hot-blast stoves, are associated with a great number of technical problems in the area of transition between the shaft and the cupola, both with regard to the refractory linings and also with regard to the external pressure supporting plate metal casings or covers. Especially in hot-blast stoves of the type including an overlapping or projecting cupola, wherein the larger diameter cupola casing is joined to the shaft casing through a horizontal metal plate in the form of a step that supports the lining of the cupola, disadvantageous stress conditions result in the casing at the area of transistion from the shaft to the cupola. On the one hand, the weight of the cupola lining is transmitted with a detrimental leverage through the horizontal plate or step to the metal casing. On the other hand, the stresses generated by the inner pressure of the hot blast stove (up to six atmospheres overpressure in modern installations) are directed through the horizontal plate or step, with the result of further extreme stressing of the metal casing. Additionally, due to relatively large temperature differences, which result from either damage to the lining during operation or atmospheric influences, there may be additional substantial stresses in the metal casing. All such stresses require a considerable expenditure for structural design and materials in order to provide reliable operation of the hot-blast stove.

Similar disadvantages are present in the hot-blast stove described in German specification DT-OS 2,003,039. Therein the cupola lining rests on brackets or consoles that are attached above a funnel-shaped widened portion widening on the metal casing, so that the weight of the lining likewise acts with a disadvantageous leverage on the metal casing. This disadvantage is amplified by the peak stresses generated through the attachment of the brackets to the metal casing.

SUMMARY OF THE INVENTION

With the above discussion in mind, it is the object of the present invention to provide a simplified structure for a hot-blast stove in the area of transition between the shaft and the cupola thereof, which substantially avoids stress concentrations in the metal casing.

This object is achieved in accordance with the present invention by providing, in the funnel-shaped widened portion of the metal shaft casing, a ring-shaped frame including a platform that carries and supports the cupola lining. The frame surrounds the refractory shaft lining and is supported without direct connection to the inner side of the metal shaft casing. With relatively simple structural means it is thus possible to obtain a base which allows independent expansion of the cupola lining and which allows problem-free transition from the shaft lining to the cupola lining. Thus, by proper selection of thickness dimensions of the brickwork and insulating layers, it is possible to insure a relatively uniform and therefore stress-free action of temperature on the metal casing. Further, the metal casing is free of stress concentrations which would otherwise result at areas of change in shape and configuration of the support elements. The metal casing surrounds the lining of the hot-blast stove in the area of transition from the shaft to the cupola, such that it can absorb with optimal cross-sectional dimensions the stresses resulting both from the inner pressure of the hot-blast stove and from the weight of the cupola lining.

It is of great advantage to arrange the ring-shaped supporting frame as a vertical extension of the cylindrical portion of the shaft casing, so that the weight of the cupola lining flows directly into the cylindrical portion of the shaft casing. Accordingly, abutments are circumferentially spaced around and on the inner side of the widened portion of the shaft casing, just above the bottom of the widened portion. The abutments thus fix the ring-shaped supporting frame in a position which is advantageous for the transmission of weight to the cylindrical portion of the shaft casing.

The supporting frame may include a tubular section having attached thereto a platform in the shape of an outwardly extending annular flange, a lower flange attached to the tubular section at a position below the platform, and reinforcing ribs provided between the lower flange, the platform and the tubular section. This structure, while being simple, provides excellent stability. If necessary, the tubular section and/or the platform may have recesses or holes therein, e.g. for the purpose of lightening the weight of the frame, or for introducing refractory material into the space between the frame and the widened portion of the shaft casing.

A further feature of the invention is that the cupola lining rests on the frame platform around the shaft lining and includes a first vertically extending single thickness brickwork, on which there is constructed a second vertically extending double thickness brickwork which projects above the widened portion of the shaft casing into the cupola casing. The double thickness brickwork has positioned thereabove the arch of the cupola lining. This structural arrangement allows the adaptation of the cupola lining to the maximal continuous temperature of the cupola and to the thermal stresses to be expected. The vertically extending brickworks are preferably provided with stepped portions which project inwardly beyond the platform of the frame into the shaft lining and which replace such shaft lining. Expansion joints filled with mineral fibers may be arranged at such stepped portions. In order to obtain an advantageous transmission of weight, the vertical axis of the centers of gravity of the vertically extending brickworks is situated in an upward extension of the cylindrical portion of the shaft casing. The space between the vertically extending brickworks and the metal casing may be filled with a refractory material.

BRIEF DESCRIPTION OF THE DRAWINGS

Other objects and features of the invention will be apparent from the following detailed description of one embodiment thereof, taken with the accompanying drawings, wherein.

DETAILED DESCRIPTION OF THE INVENTION

Figure 1:
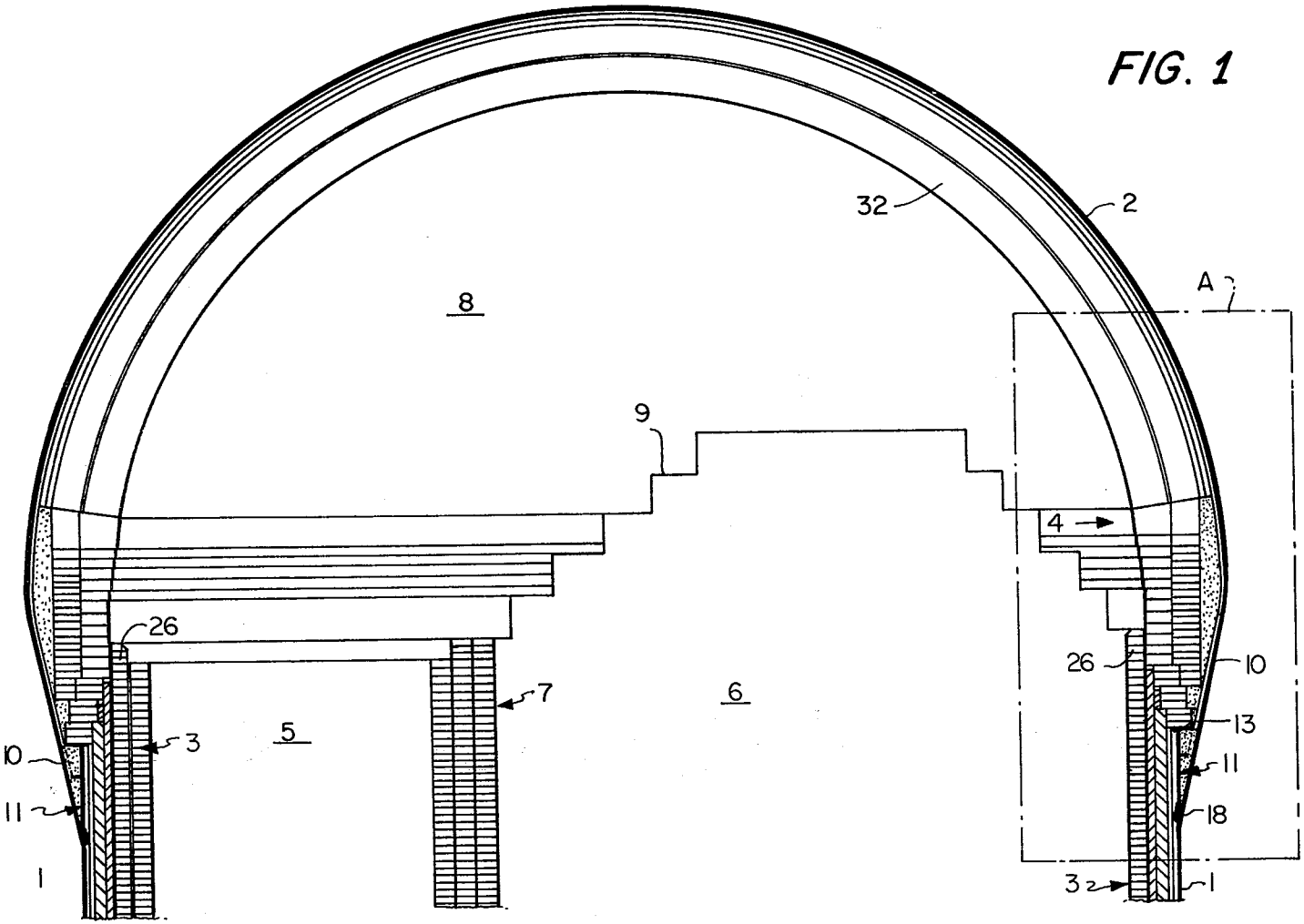
FIG. 1 is a vertical section through the upper portion of an inner-shaft hot-blast stove constructed in accordance with the present invention.

With reference now to the drawings, an inner-shaft hot-blast stove includes a cylindrical plate metal shaft casing 1, a plate metal cupola casing 2, a refractory shaft lining 3, and a refractory cupola lining 4. Shaft lining 3 includes a combustion chamber shaft 5 and a grating shaft 6 separated by an intermediate partition 7, while cupola lining 4 surrounds a cupola chamber 8, which establishes communication between the two shafts 5 and 6.

The hot-blast stove works on the regenerative principle. During the heating-up phase, the heating gases escaping from the upper portion of combustion chamber 5 are reversed in cupola chamber 8 and led into a grating 9 consisting of heat storage bricks. The heating gases leave the grating at the lower end of the hot-blast stove. The heating-up phase is followed by the cold-blasting phase, wherein the cold blast is led from below in an upward direction through grating 9 and warmed up thereby. The resultant hot blast is discharged from the hot-blast stove through a hot-blast outlet arranged in the combustion chamber. Moreover, the connections of the hot-blast stove for the entry of combustion air and fuel gas, for the discharge of exhaust gas, for the entry of cold blast and for the discharge of the hot blast are not required for the explanation of the present invention and are therefore omitted for the sake of simplicity.

Figure 2:
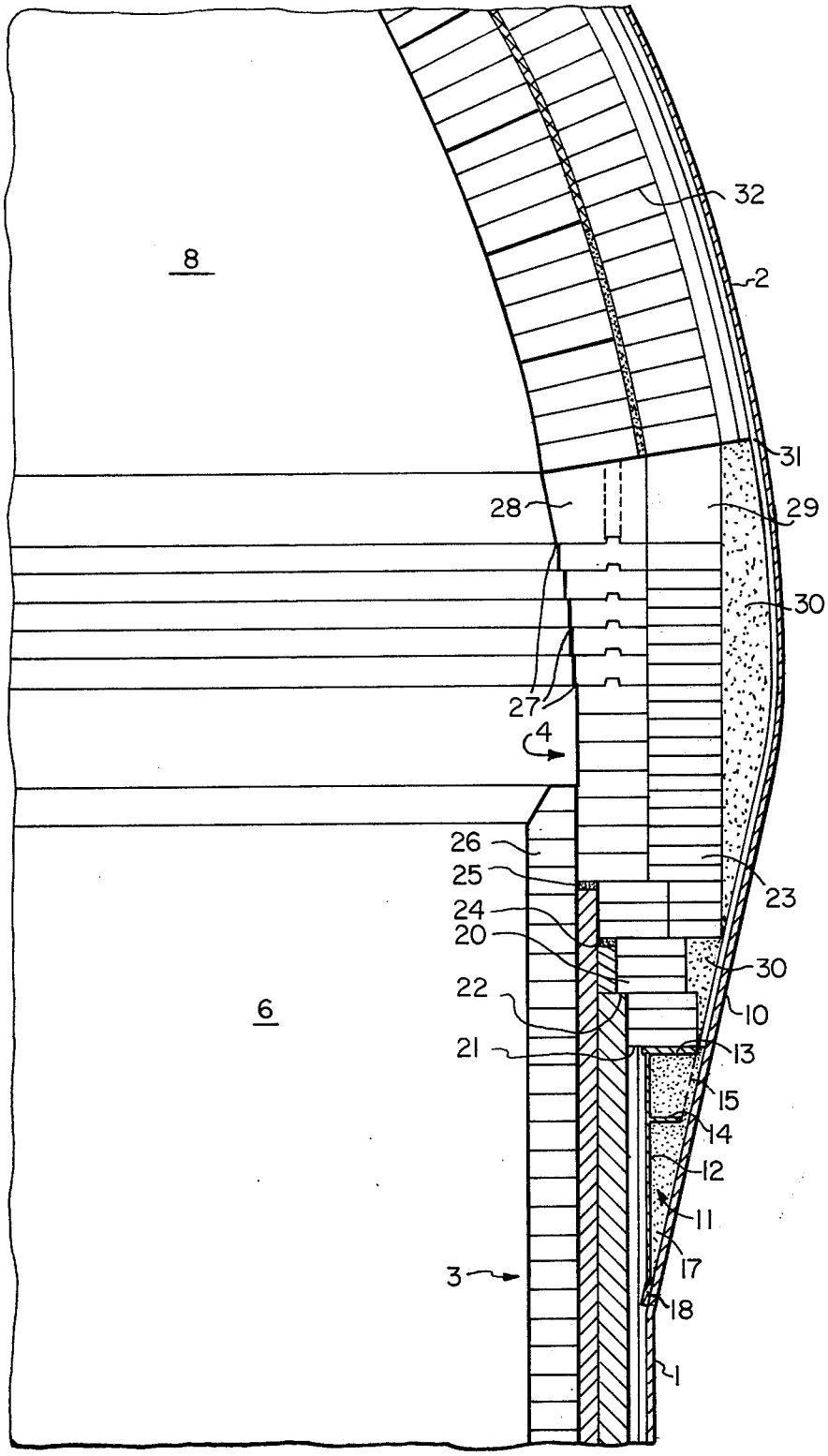
FIG. 2 is a section of portion A of FIG. 1 on an enlarged scale.
Figure 3:
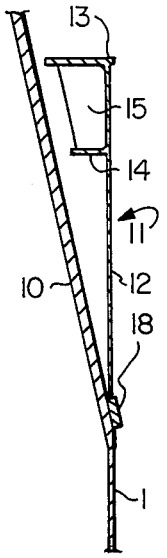
FIg. 3 is a sectional profile view of a widened portion of the shaft casing and the supporting frame for the cupola brickwork in accordance with the invention.
Figure 4:
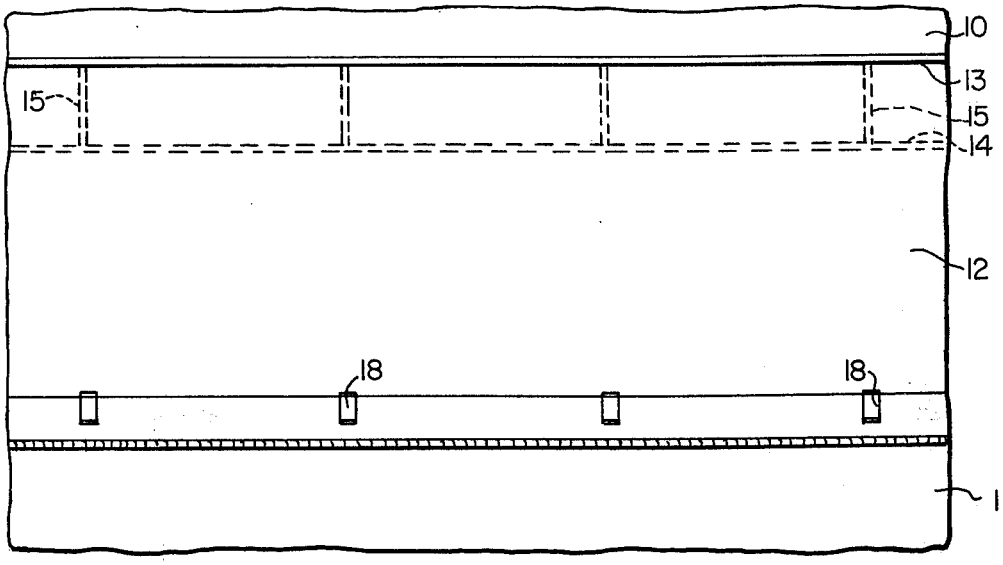
FIG. 4 is a lateral elevation view of the structure of FIG. 3.

As seen especially in FIGS. 1 and 2, shaft casing 1 has at the upper end thereof a funnel-shaped widened section or portion 10, which joins the cylindrical section or portion of shaft casing 1 to cupola casing 2 of a larger diameter. Shaft lining 3 projects vertically to a position within funnel-shaped widened portion 10 of casing 1, so that an annular space is provided between shaft lining 3 and widened portion 10. An annular supporting frame 11, which carries and supports cupola lining 4, is arranged in such annular space.

Figure 5:
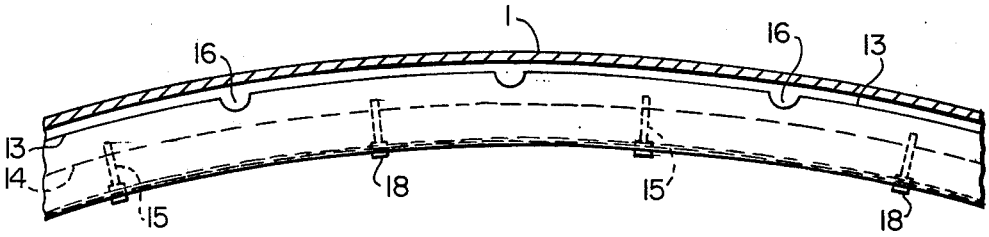
FIG. 5 is a plan view of the structure of FIG. 4.

Supporting frame 11 is provided with a tubular member 12, to which there are attached a platform 13 in the form of a laterally extending annular member, and an annular flange 14 at a position below the platform 13. Vertical reinforcing ribs 15 are distributed uniformly around the circumference of the tubular member 12 between platform 13 and flange 14 and are fixed to member 12, platform 13 and flange 14. The outer circumferential edge of platform 13 extends to a position adjacent or near widened portion 10 of shaft casing 1 and is provided with holes or recesses 16 (FIG. 5), through which the free annular space below platform 13 and between tubular member 12 and widened portion 10 may be filled with a refractory material 17. Tubular section 12 of supporting frame 11 forms a vertical continuation of shaft casing 1 and rests on abutments 18, that are circumferentially spaced in a horizontal plane around and on the inner surface of the plate metal casing directly above the bottom of widened portion 10.

Cupola lining 4 is constructed above and is supported on platform 13. Cupola lining 4 includes a vertically extending single thickness brickwork 20, which extends inwardly and replaces the outer layers of shaft lining 3. Specifically, a lowermost portion 21 projects inwardly beyond platform 13 to replace the outermost layer of lining 3 and a further inwardly projecting portion 22 replaces yet more of lining 3. Above single thickness brickwork 20 is provided a double layer or thickness cupola brickwork 23, which also extends vertically, and which has successively inwardly projecting portions 24 and 25 which replace the remaining layers of shaft lining 3, with the exception of the innermost non-supporting or free layer 26. Expansion joints may be provided at the projecting portions 21, 22, 24 and 25. Somewhat above the area of the maximum diameter of cupola casing 2, the double layer cupola brickwork 23 ends with a layer of shaped bricks 28 and 29. Cupola brickwork 23 is sequentially made thicker in the inward direction, with the resultant provision of a plurality of small inward projections 27.

Both of the vertically extending cupola brickworks 20 and 23 are surrounded by a refractory material 30, which fills the space extending from brickworks 20 and 23 to casing 2 and portion 10, the inner surfaces of which are provided with an insulating layer 31, which extends upwardly from platform 13 throughout the entire cupola.

The remainder of the cupola lining is in the form of an arch 32 erected on the top end surfaces of shaped bricks 28 and 29. The top surfaces of bricks 28 and 29 are shaped to incline obliquely downwardly and inwardly toward the interior of the hot-blast stove. The arch 32 includes a plurality of refractory brickwork layers and insulating layers.

It will be apparent that modifications may be made to the above specifically described structural arrangement without departing from the scope of the invention.

What is claimed is:

1. A hot-blast stove comprising:

a vertically extending metallic shaft casing having therein a refractory shaft lining surrounding a combustion shaft chamber and a grating shaft, said shaft casing including a lower cylindrical section and an upper funnel-shaped widened section integrally joined to said cylindrical section and flaring upwardly and outwardly therefrom;

a metallic cupola casing having a configuration of part of a sphere of a diameter greater than that of said cylindrical section, said cupola casing being integrally joined to said shaft casing at the upper end of said funnel-shaped widened section thereof, said cupola casing having therein a refractory cupola lining;

an annular supporting frame positioned within and rigidly attached to said funnel-shaped widened section, said supporting frame surrounding said shaft lining and being free of direct attachment to said cylindrical section; and said supporting frame having integrally attached thereto an annular platform supporting said cupola lining.

2. A stove as claimed in claim 1, wherein said supporting frame is positioned in an upward extension of said cylindrical section of said shaft casing.

3. A stove as claimed in claim 2, further comprising abutments circumferentially spaced around and attached to the inner surface of said funnel-shaped widened section directly above the lower end thereof, said supporting frame being supported by said abutments.

4. A stove as claimed in claim 3, wherein said supporting frame comprises a tubular member attached to and extending upwardly from said abutments, said platform comprising an annular member attached to said tubular section.

5. A stove as claimed in claim 4, wherein said supporting frame further comprises an annular flange attached to said tubular member at a position below said platform, and a plurality of reinforcing ribs spaced about said tubular member and attached thereto and to said platform and said annular flange.

6. A stove as claimed in claim 5, further comprising holes provided in at least one of said platform and tubular member.

7. A stove as claimed in claim 1, further comprising an annular space between said funnel-shaped widened section and said supporting frame, said annular space being filled with refractory material.

8. A stove as claimed in claim 1, wherein said cupola lining comprises a first, vertically extending, single thickness brickwork resting directly on said platform; a second, vertically extending, double thickness brickwork extending upwardly from said single thickness brickwork beyond the upper end of said funnel-shaped widened section into said cupola casing; and an arch-shaped brickwork above said double thickness brickwork.

9. A stove as claimed in claim 8, wherein said first and second brickworks project successively further inwardly to form steps in the upward direction.

10. A stove as claimed in claim 9, further comprising expansion joints at said steps.

11. A stove as claimed in claim 8, wherein the vertical axis of the centers of gravity of said first and second brickworks is positioned in an upward extension of said cylindrical section of said shaft casing.

12. A stove as claimed in claim 8, further comprising space between said first and second brickworks and said funnel-shaped widened section of said shaft casing and said cupola casing, said space being filled with refractory material.

* * * * *